US005536200A

United States Patent [19]

Kiess

[11] Patent Number: 5,536,200

[45] Date of Patent: Jul. 16, 1996

[54] NOZZLE OF A SAND BLASTER FOR DUST-FREE BLASTING OF PLANAR SURFACES

[76] Inventor: Karl H. Kiess, Oemberg 31, Muelheim/Ruhr, Germany, 45481

[21] Appl. No.: 313,247

[22] PCT Filed: Nov. 8, 1993

[86] PCT No.: PCT/EP93/03125

§ 371 Date: Oct. 31, 1994

§ 102(e) Date: Oct. 31, 1994

[87] PCT Pub. No.: WO94/18004

PCT Pub. Date: Aug. 18, 1994

[30] Foreign Application Priority Data

Feb. 3, 1993 [DE] Germany ..... 43 03 188.9

[51] Int. Cl.[6] ..... B24C 5/04

[52] U.S. Cl. ..... 451/102; 451/75

[58] Field of Search ..... 451/75, 76, 91, 451/99, 102, 101, 90, 100, 95

[56] References Cited

U.S. PATENT DOCUMENTS

| | | | |
|---|---|---|---|
| 1,944,404 | 1/1934 | Coble et al. | 51/11 |
| 2,358,557 | 9/1944 | Boyd et al. | 51/8 |
| 2,557,106 | 6/1951 | Hughes | 299/145 |
| 2,816,799 | 12/1957 | English | 299/73 |
| 3,344,558 | 10/1967 | Kirkland | 451/102 |
| 3,972,150 | 8/1976 | Hart | 451/90 |
| 4,704,826 | 11/1987 | Kirkland | 451/102 |
| 4,819,388 | 4/1989 | Kirkland | 451/102 |
| 5,248,094 | 9/1993 | Munoz | 451/102 |
| 5,255,853 | 10/1993 | Munoz | 451/102 |

FOREIGN PATENT DOCUMENTS

| | | | |
|---|---|---|---|
| 3834896 | 11/1990 | Germany . | |
| 0905035 | 2/1982 | U.S.S.R. | 451/102 |

*Primary Examiner*—Bruce M. Kisliuk
*Assistant Examiner*—Derris Banks
*Attorney, Agent, or Firm*—Townsend and Townsend and Crew

[57] ABSTRACT

A nozzle for a sand blaster for dust-free blasting of plain surfaces comprises a tubular housing (1) with a revolving nozzle head (3) which is connectable to a blast hose (2). The nozzle head (3) is covered with an end plate (4) provided with inclined orifices (7) so that the nozzle head (3) will be revolved by the throw of the sand blasting material. For a better adaptability to different demands for cleaning, each orifice (7) is provided with a slewable blast pipe (9) which is mounted slewable with a socket joint (10) at the end plate (4).

3 Claims, 1 Drawing Sheet

NOZZLE OF A SAND BLASTER FOR DUST-FREE BLASTING OF PLANAR SURFACES

BACKGROUND OF THE INVENTION

The invention relates to a nozzle of a sand blaster for dust-free blasting of plain surfaces comprising a tubular housing connectable to a blast hose and provided with a revolving nozzle head diffuserlike enlarged and covered with an end plate which is provided with inclined orifices, so that the nozzle head is revolved by the throw of the sand blasting material.

For dust-free sand blasting of plain surfaces, sand blasters are known which are provided with a hood mounted on the nozzle head for covering the blasted area and comprising installations for sucking off the blasting material and the dust. The nozzle head is provided with a venturi nozzle which directs the sand blasting material abrasive in a conical shape against the surface to be blasted. The nozzle head is moved over the surface strip by strip. For a revolving drive of the nozzle head, but avoiding an additional motor, a blast nozzle is known from DE 38 34 896 C2. The end plate of it is provided with inclined orifices so that the diffuserlike enlarged nozzle head is revolved by the throw of the abrasive-air mixture. For adjustment to more or less wide blasting strips and/or blasting effects on the surface to be blasted, the disadvantage is that several end plates of different design provided with appropriate orifices must be available and stored.

SUMMARY OF THE INVENTION

It is therefore an object of the invention to develop a blast nozzle in such a way that higher adaptability to the cleaning operations is possible.

This problem is solved in accordance with the invention by providing each orifice with a slewable blast pipe.

In accordance with the invention, the blast pipes allocated to the end plate are adjustable into the most effective position for cleaning operations. By a radial adjustment the width of blasted strip can be enlarged or reduced and by a tangential adjustment the inclination of the blasting may be changed. Depending on the nature of the material to be blasted and the pollution, the best adaptability can be achieved by adjusting the blast pipes. Where, for example, a hard coat of dirt is to be blasted, an appropriate hard blasting of the surface is adjustable.

The bearing of the blast pipes on the end plate may be made in different ways. Preferably, the blast pipe is carried slewable by a socket joint at the end plate. At this, a pipe socket provided with a ball cup for the socket joint may be attached at the edge of each orifice. Besides that, the socket joint preferably is provided with fastening devices which fix the blast pipe in the adjusted slewing position.

BRIEF DESCRIPTION OF THE DRAWINGS

The drawings illustrate an example of the invention.

DESCRIPTION OF THE PREFERRED EMBODIMENTS

Figure 1:
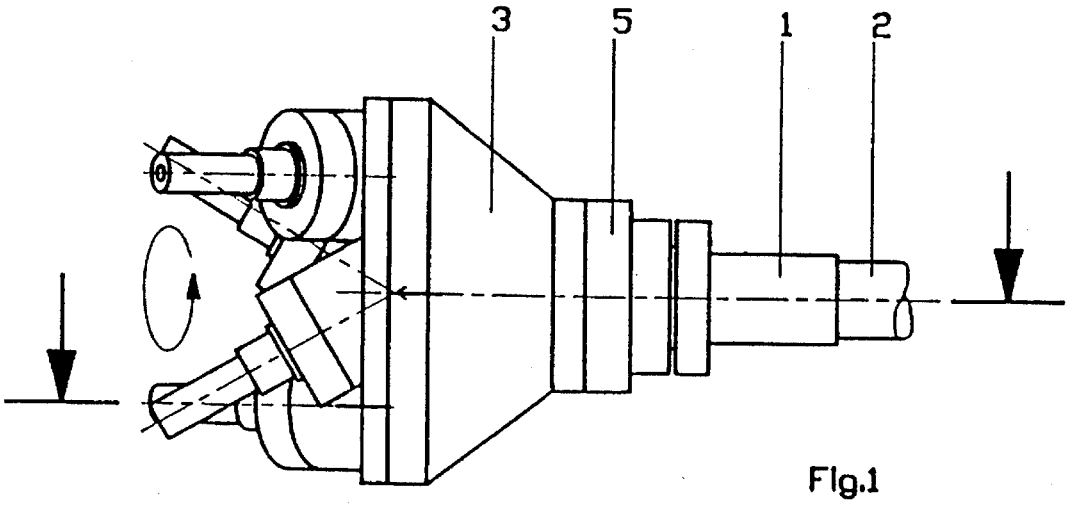
FIG. 1 is a side view of a blast nozzle for dust-free blasting of planar surfaces.

The blast nozzle for sand blasters for a dust-free blasting of planar surfaces as shown in FIG. 1 substantially consists of a tubular housing 1 with an equipment for connecting a blast hose 2. At the front a nozzle head 3 is provided which is enlarged diffuserlike. The nozzle head 3 is provided with an exchangeable end plate 4 which is fastened by appropriate fixing devices, such as screws and the like. Furthermore, but not shown in the drawing, the blast nozzle is provided with a hood that is supplied with suction installations.

Figure 2:
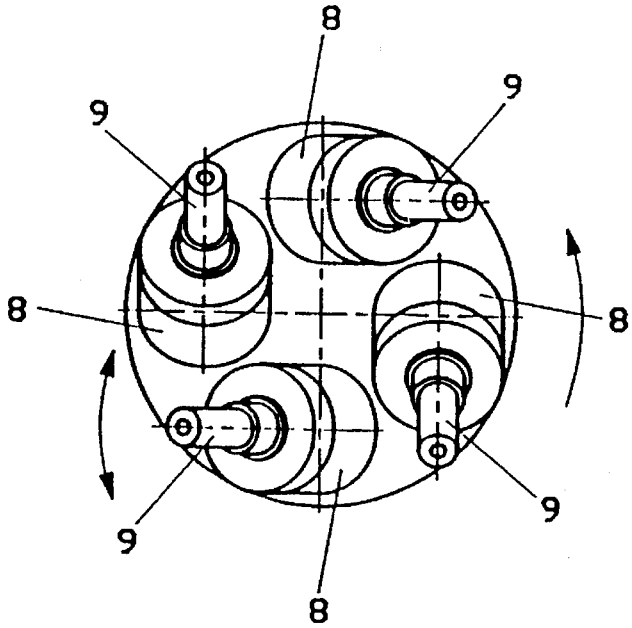
FIG. 2 is a front end view of the subject of FIG. 1.
Figure 3:
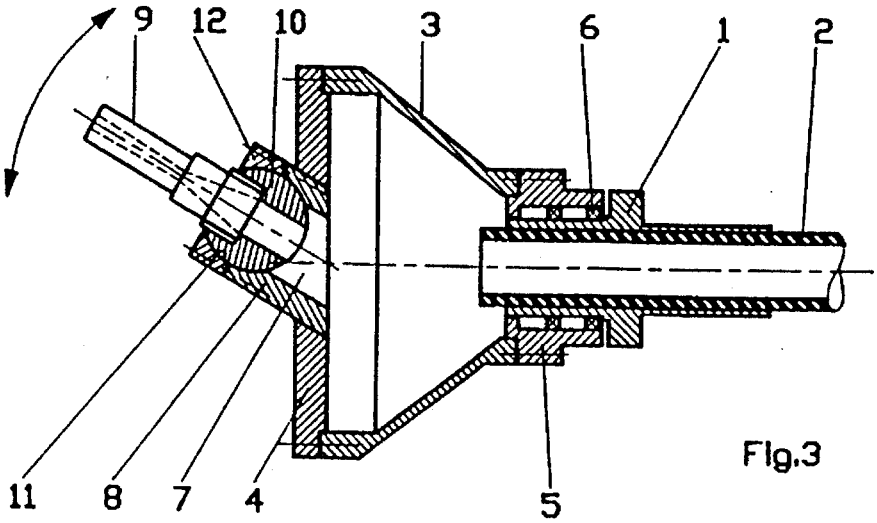
FIG. 3 is a central cross-sectional view of the subject of FIG. 1 wherein, for a better representation, the section of the blast pipe is shown in a displaced position.

As shown in FIG. 3, the conical nozzle head is provided with a collar 5, which is mounted revolvingly on the housing 1 by means of a rolling bearing 6. The blasting material, consisting of the carrier gas with the abrasive sand or other particles, is blown through the blast hose 2 into the nozzle head 3. The end plate 4 mounted in the frontal opening of the nozzle head 3 is supplied with four inclined drill-hole-like orifices 7, which are arranged transversely through the head plate 4 in one rotary direction. The axes of these inclined orifices 7 run in such a way that a rotation of the nozzle head 3, in the direction of the arrow shown in FIG. 2, is effected. As shown particularly in FIG. 3, a pipe socket 8 is attached at the edge of each orifice 7. Each pipe socket 8 forms a support for one blast pipe 9. For a slewable bearing each blast pipe 9 is provided with a socket joint 10, that is slewable in a ball cup 11, allocated to the pipe socket so that the direction of the blast pipe can be freely selected within a frustoconical envelope 8.

An adjusting nut 12 permits the fixing of the blast pipe 9 in its adjusted position. The pipe sockets 8, allocated to the orifices 7, are fixed in the same inclined position as the corresponding orifices 7, as shown particularly clearly in FIG. 2. On the other hand, the blast pipes 9 can be adjusted individually by means of the socket joint 10.

Both the number of blast pipes 9 allocated to the nozzle head 3 and the slewable bearing at the end plate 4, may be applied in different versions. It is possible, for example, to use a simple swivel bearing instead of a socket joint, whereby bearing necks can be provided at the blast pipe 9, which are placed in the corresponding drills of the pipe socket 8 or of the orifice 7. The slewing axis of such a bearing can lie in different ways, with regard to middle axis of the discoid end plate 4, in an inclined position, if possible, but also in positions where the slewing axis is arranged radial or tangential. The orifice 7 can have other profiles instead of a cylindrical one.

List of Reference Numbers

1 tubular housing
2 blast hose
3 nozzle head
4 end plate
5 collar
6 rolling bearing
7 orifices
8 pipe socket
9 blast pipe
10 socket joint
11 ball cup
12 adjusting nut

What is claimed is:

1. Nozzle for a sand blaster for a dust-free blasting of planar surfaces with a blast material comprising a tubular housing having a longitudinal axis, the housing being connectable to a blast hose for the blast material and provided with a revolving nozzle head having an open end covered with an end plate including inclined orifices a blast pipe for each orifice, a socket joint for each blast pipe including a ball member cooperating with a cup for slewably mounting the blast pipe on the end plate, and a fastening device for fixing the blast pipe relative to the end plate in a desired slewing position; whereby streams of the blast material discharged from the blast pipes cause rotation of the nozzle head.

2. Nozzle according to claim 1, wherein a pipe socket forms the cup of the socket joint.

3. A nozzle for blasting planar surfaces with a blast material including a granular abrasive and a fluid medium, the nozzle comprising a tubular housing having a longitudinal axis and adapted to be connected to a hose, the housing having an open front end, a cover plate closing the open front end and secured to the housing, the cover plate including a plurality of pipe sockets axes of which are inclined relative to the longitudinal axis by an angle of less than 90° and communicating an interior of the housing with an exterior thereof, means permitting rotation of the cover plate relative to the hose, an elongated blast pipe for each pipe socket, a ball joint coupling the blast pipe to the pipe socket, establishing fluid communication between the housing interior and the blast pipe, and permitting slewing of the blast pipe relative to the pipe socket within a frustoconical envelope for changing a direction of a stream of blast material issuing from the blast pipe to thereby vary an area of the planar surface impacted by the stream of blast material as a result of rotation of the cover plate and to further adjust a circle concentric with the longitudinal axis to which the axis of the blast pipe is tangential to therewith impart rotation to the end plate relative to the hose, and means for fixing the blast pipe relative to the end plate in a selected position of the blast pipe.

* * * * *

UNITED STATES PATENT AND TRADEMARK OFFICE

CERTIFICATE OF CORRECTION

PATENT NO. : 5,536,200

DATED : July 16, 1996

INVENTOR(S) : Karl H. Kiess

It is certified that error appears in the above-identified patent and that said Letters Patent is hereby corrected as shown below:

On title page, under "[30] Foreign Application Priority Data" change "Feb. 3, 1993" to --Feb. 4, 1993--.

Signed and Sealed this

Twelfth Day of November, 1996

*Attest:*

Bruce Lehman

BRUCE LEHMAN

*Attesting Officer*

*Commissioner of Patents and Trademarks*